US012270402B2

(12) United States Patent
Sawada

(10) Patent No.: US 12,270,402 B2
(45) Date of Patent: Apr. 8, 2025

(54) FAN AND INDOOR EQUIPMENT

(71) Applicant: FUJITSU GENERAL LIMITED, Kanagawa (JP)

(72) Inventor: Hirotaka Sawada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 4 days.

(21) Appl. No.: 18/275,106

(22) PCT Filed: Mar. 1, 2022

(86) PCT No.: PCT/JP2022/008501
§ 371 (c)(1),
(2) Date: Jul. 31, 2023

(87) PCT Pub. No.: WO2022/186176
PCT Pub. Date: Sep. 9, 2022

(65) Prior Publication Data

US 2024/0133384 A1 Apr. 25, 2024
US 2024/0229801 A9 Jul. 11, 2024

(30) Foreign Application Priority Data

Mar. 1, 2021 (JP) ..... 2021-031769

(51) Int. Cl.
*F24F 1/0025* (2019.01)
*F04D 17/04* (2006.01)
*F04D 29/28* (2006.01)

(52) U.S. Cl.
CPC ..... *F04D 17/04* (2013.01); *F04D 29/281* (2013.01); *F24F 1/0025* (2013.01)

(58) Field of Classification Search
CPC ..... F04D 17/04; F04D 29/281; F24F 1/0025
See application file for complete search history.

(56) References Cited

U.S. PATENT DOCUMENTS 5,611,667 A * 3/1997 Nagamori ..... F04D 29/666 416/200 R
5,827,046 A * 10/1998 Konno ..... F04D 29/283 416/200 R
2022/0372990 A1* 11/2022 Teramoto ..... F04D 29/4213

FOREIGN PATENT DOCUMENTS

CN 108757556 A 11/2018
EP 0816687 A2 1/1998
(Continued)

OTHER PUBLICATIONS

European Search Report issued for related EP Application No. 22763231.2.

*Primary Examiner* — Sabbir Hasan
(74) *Attorney, Agent, or Firm* — Paratus Law Group, PLLC

(57) ABSTRACT

A fan includes a multi wing fan and a mechanism configured to rotate the multi wing fan around a rotation axis, wherein the multi wing fan includes two impellers lined in an axial direction is parallel to the rotation axis, and a partition plate arranged along a plane perpendicular to the rotation axis, the partition plate includes a body part that separates the two impellers, and an outer circumferential part that surrounds an outer circumferential side of the body part, the outer circumferential part gets thinner toward an outer circumferential edge of the partition plate, the outer circumferential edge includes a first outer circumferential edge part, and a second outer circumferential edge part different from the first outer circumferential edge part, and a position of the first outer circumferential edge part in the axial direction is different from a position of the second outer circumferential edge part in the axial direction.

5 Claims, 6 Drawing Sheets

(56) References Cited

FOREIGN PATENT DOCUMENTS

| | | | | |
|---|---|---|---|---|
| EP | 0816687 | A3 | | 11/1998 |
| EP | 4431747 | A1 | | 9/2024 |
| JP | S51-066210 | U | | 5/1976 |
| JP | S51-150712 | A | | 12/1976 |
| JP | S56136192 | U | * | 10/1981 |
| JP | H05-272487 | A | | 10/1993 |
| JP | H05-340387 | A | | 12/1993 |
| JP | H06-137295 | A | | 5/1994 |
| JP | H08-284876 | A | | 10/1996 |
| JP | H11-324981 | A | | 11/1999 |
| JP | 2001-173587 | A | | 6/2001 |
| JP | 2006-329098 | A | | 12/2006 |
| JP | 2010-007609 | A | | 1/2010 |
| WO | WO 2017/145383 | A1 | | 8/2017 |

* cited by examiner

FAN AND INDOOR EQUIPMENT

CROSS REFERENCE TO PRIOR APPLICATION

This application is a National Stage Patent Application of PCT International Patent Application No. PCT/JP2022/008501 (filed on Mar. 1, 2022) under 35 U.S.C. § 371, which claims priority to Japanese Patent Application No. 2021-031769 (filed on Mar. 1, 2021), which are all hereby incorporated by reference in their entirety.

FIELD

The disclosed technique relates to a blower and indoor equipment.

BACKGROUND

Indoor equipment of an air conditioner that is provided with a tangential fan is known. The tangential fan includes a plurality of impellers that are lined in an axial direction and a plurality of partition plates that separate the impellers. In a fan, a peripheral cross-section of the partition plate is formed into a triangular shape and accordingly it is possible to reduce a turbulence flow of air that strikes the partition plates and separation phenomenon and thus increase the air volume and reduce noise (Patent Literature 1).

CITATION LIST

Patent Literature

Patent Literature 1: Japanese Laid-open Patent Publication No. 2001-173587

SUMMARY

Technical Problem

Air that is blown from the impellers is blown out in a direction perpendicular to the axial direction and, because of the effect of a boundary layer that is formed near the partition plate, an airflow in a width corresponding to a width between adjacent partition plates that is reduced by the thickness of the boundary layer is blown out. The width of the airflow reduces and accordingly the air volume of the fan reduces.

The disclosed technique was made in view of the aspect and an object of the technique is to provide a fan that diffuses blown-out air in an axial direction and indoor equipment.

Solution to Problem

According to an aspect of an embodiment, a fan includes a multi wing fan, and a mechanism configured to rotate the multi wing fan around a rotation axis, wherein the multi wing fan includes a plurality of impellers that are lined in an axial direction that is parallel to the rotation axis, and a partition plate that is arranged along a plane that is perpendicular to the rotation axis, the partition plate includes a body part that separates two impellers among the plurality of impellers, and an outer circumferential part that surrounds an outer circumferential side of the body part that is perpendicular to the rotation axis, the outer circumferential part is formed such that the outer circumferential part gets thinner toward an outer circumferential edge of the partition plate, the outer circumferential edge of the partition plate is formed of a plurality of outer circumferential edge parts that are continuous in a circumferential direction, and a first position of a first outer circumferential edge part among the plurality of outer circumferential edge parts in the axial direction is different from a second position of a second outer circumferential edge part different from the first outer circumferential edge part among the plurality of outer circumferential edge parts in the axial direction.

Advantageous Effects of Invention

The fan and the indoor equipment that are disclosed are able to inhibit the air volume from lowering.

DESCRIPTION OF EMBODIMENTS

Figure 1:
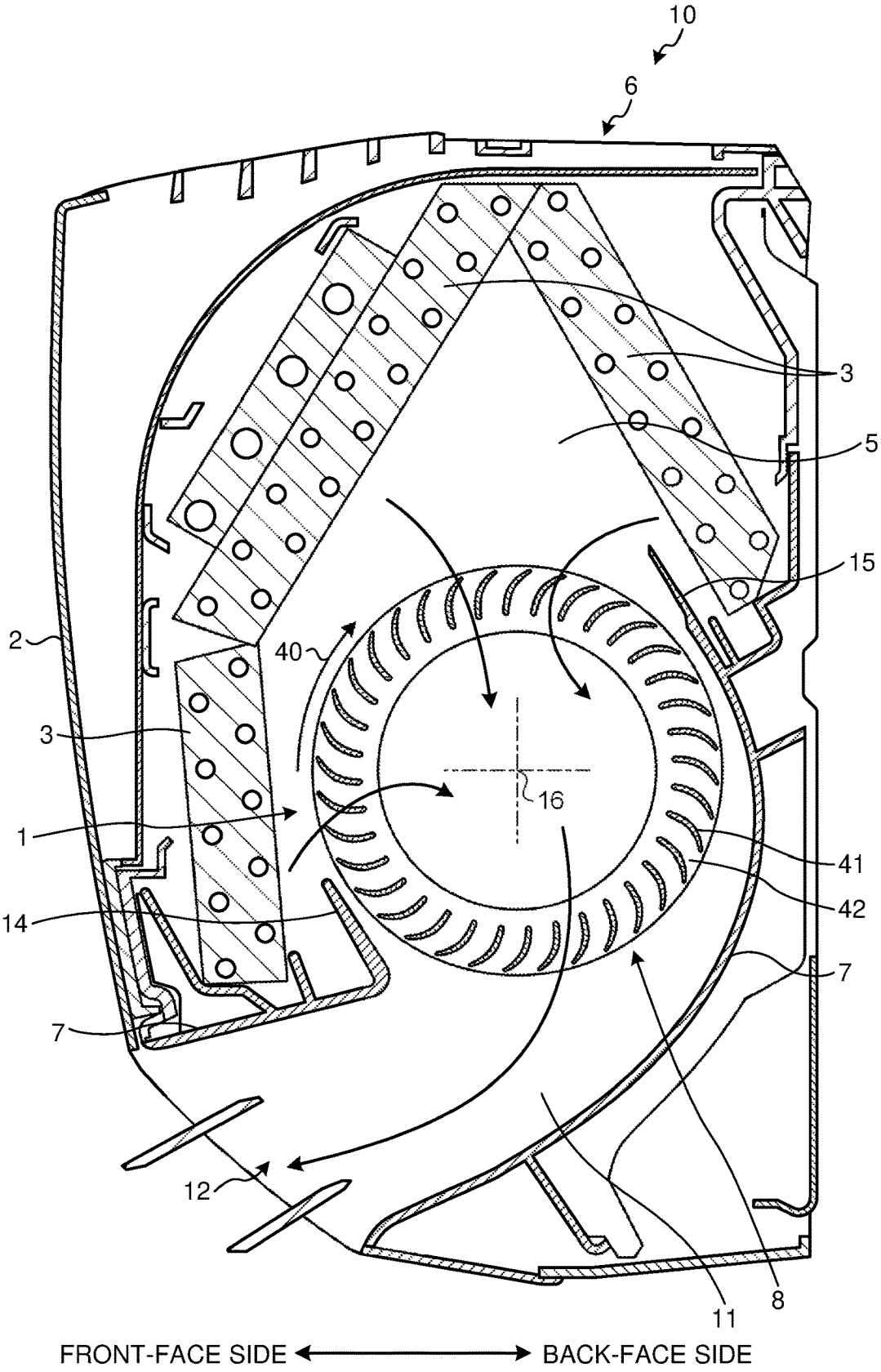
FIG. 1 is a cross-sectional view illustrating indoor equipment that is provided with a fan of an embodiment.

A fan and indoor equipment according to an embodiment disclosed by the present application will be described below with reference to the drawings. The description below does not limit the technique of the disclosure. In the following description, the same components are denoted with the same reference numerals and thus redundant description will be omitted.

Embodiment

As illustrated in FIG. 1, a fan 1 of the embodiment is provided in indoor equipment 10 of an air conditioner. FIG. 1 is a cross-sectional view illustrating the indoor equipment 10 that is provided with the fan 1 of the embodiment. The air conditioner includes the indoor equipment 10 and includes outdoor equipment not illustrated in the drawing. The outdoor equipment is set outdoors. The indoor equipment 10 is set on a wall surface of an air-conditioned room that is separated from the outdoors. The indoor equipment 10 includes the fan 1, a housing 2, and a heat exchanger 3. An air path 5 is formed in the housing 2. In an upper part of the housing 2, an intake 6 allowing communication between the air path 5 and the outside of the housing 2 is formed. The heat exchanger 3 is arranged in the air path 5. The fan 1 is arranged under the heat exchanger 3 in the air path 5. The fan 1 is driven to rotate by a mechanism to be described below and accordingly an airflow that passes through the heat exchanger 3 is generated. In the following description, in the view in FIG. 1, the left side is referred to as the side of the front face of the housing 2 and the right side is referred to as the side of a back face of the housing 2.

The fan 1 includes a fan casing 7 and a tangential fan 8. The fan casing 7 is arranged in the housing 2 or is formed uniformly with the housing 2 and is fixed to the housing 2.

In the fan casing 7, a blow path 11 and a blow-out port 12 are formed. An end of the blow path 11 is connected to an area between the fan 1 and the heat exchanger 3 in the air path 5. The blow-out port 12 is arranged at a lower end of the fan casing 7. The other end of the blow path 11 is connected to the blow-out port 12 and is connected to the outside of the housing 2 of the indoor equipment 10 via the blow-out port 12.

The tangential fan 8 is arranged in the blow path 11. The fan casing 7 includes a front-face-side tongue part 14 and a back-face-side tongue part 15. The front-face-side tongue part 14 is arranged on the front-face side of the housing 2. The back-face-side tongue part 15 is arranged on the side of the back face of the housing 2.

Figure 2:
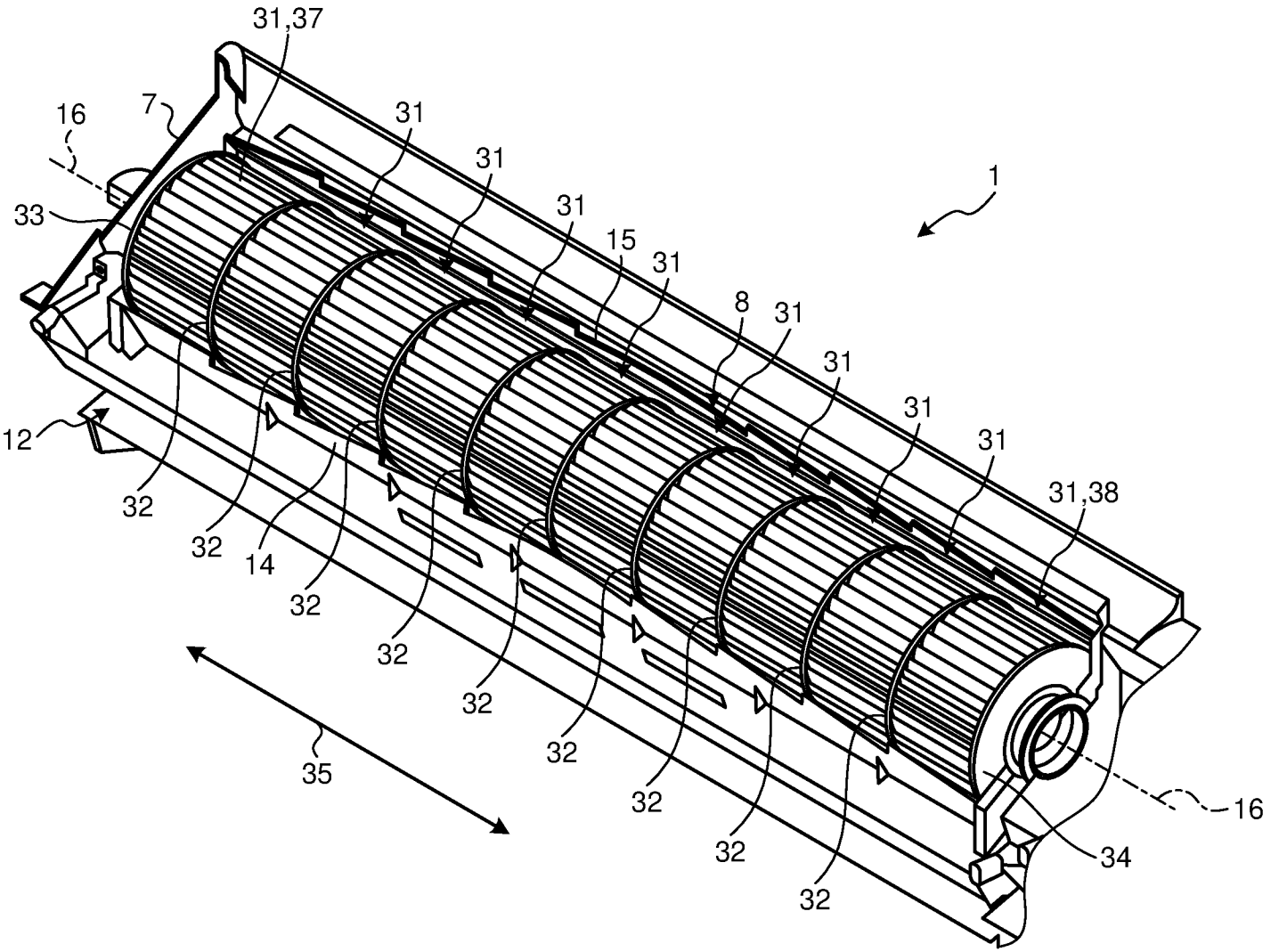
FIG. 2 is a perspective view illustrating the fan of the embodiment.

FIG. 2 is a perspective view illustrating the fan 1 of the embodiment. The tangential fan 8 is formed into an approximately rod-like shape, is arranged in the blow path 11 along a width direction of the housing 2 (in a depth direction at a viewpoint in FIG. 1), and is rotatably supported by the fan casing 7 on a rotation axis 16. The tangential fan 8 includes a plurality of impellers 31, a plurality of partition plates 32, a first end plate 33, and a second end plate 34. The impellers 31 are lined in an axial direction 35 that is parallel to the rotation axis 16 and are fixed to each other via the partition plates 32. An impeller 36 that is one of the impellers 31 includes a plurality of wings 41. As illustrated in FIG. 1, a cross-section of each of the wings 41 that is perpendicular to the axial direction 35 has a flattened shape and has a shape in which the wing 41 curves in a rotational direction 40 toward an outer circumferential direction from the rotation axis 16. Each of the wings 41 is lined in a direction of a circumference on the rotation axis 16 and is arranged along the axial direction 35 parallel to the rotation axis 16. Other impellers different from the impeller 36 among the impellers 31 include the wings 41 as the impeller 36 does.

Each of the partition plates 32 is formed into an approximately disc-like shape. Each of the partition plates 32 is arranged perpendicularly to the axial direction 35. Each of the partition plates 32 is arranged between two of the impellers 31 and is fixed to the wings 41 of the two impellers.

The first end plate 33 is formed into an approximately disc-like shape. The first end plate 33 is arranged at an end of the tangential fan 8 along a plane perpendicular to the axial direction 35 and is fixed to the wings 41 of a first impeller 37 that is arranged at an end of the impellers 31. The second end plate 34 is formed into an approximately disc-like shape. The second end plate 34 is arranged at another end of the tangential fan 8 along a plane perpendicular to the axial direction 35 and is fixed to the wings 41 of a second impeller 38 that is arranged at the other end of the impellers 31.

The front-face-side tongue part 14 is formed into a band-like shape and is arranged at the side of a front face of the blow path 11 along a straight line that is parallel to the axial direction 35 and along an outer circumferential surface of the tangential fan 8. The back-face-side tongue part 15 is formed into a band-like shape and is arranged at the side of a back face of the blow path 11 along the axial direction 35 and along the outer circumferential surface of the tangential fan 8.

The fan 1 further includes a motor unit that is not illustrated in the drawing. The motor unit is a mechanism that causes the tangential fan 8 to rotate on the rotation axis 16 in the pre-determined rotational direction 40 as illustrated in FIG. 1.

Figure 3:
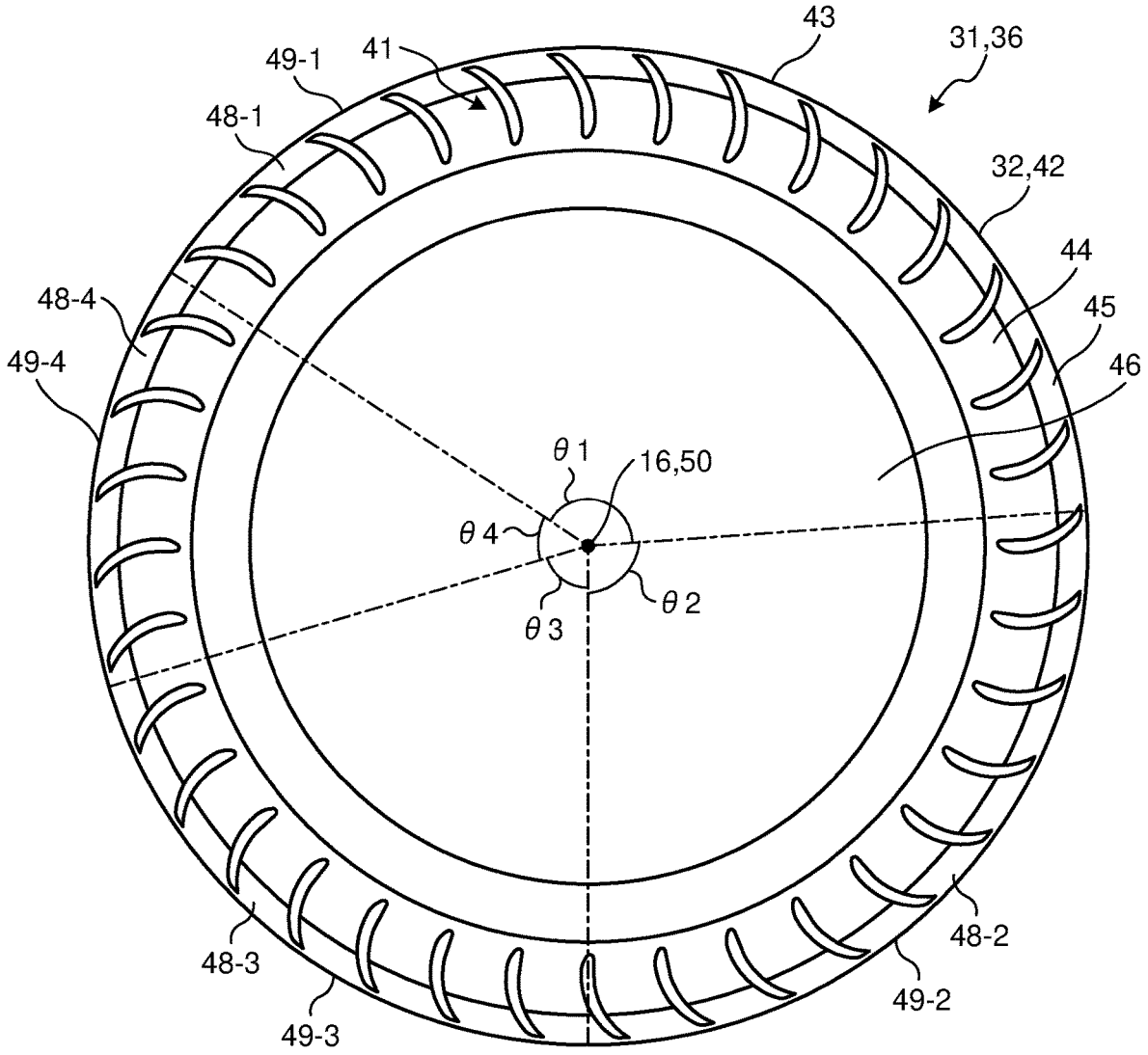
FIG. 3 is a plane view illustrating a partition plate.

As illustrated in FIG. 3, a partition plate 42 that is one of the partition plates 32 is formed into a disc-like shape. FIG. 3 is a plane view illustrating the partition plate 42. The partition plate 42 is arranged such that an outer circumferential edge 43 of the partition plate 42 is along a circle on the rotation axis 16. The partition plate 42 includes a body part 44 and an outer circumferential part 45. A hole 46 is formed in the body part 44. The hole 46 is formed at the center of the partition plate 42 such that the edge of the hole 46 is along a circle on the rotation axis 16. The outer circumferential part 45 is formed such that the outer circumferential part 45 surrounds an outer circumferential side of the body part 44 perpendicular to the rotation axis. An outer circumferential edge 43 is formed in the outer circumferential part 45.

The outer circumferential part 45 is formed of a plurality of outer circumferential parts 48-1 to 48-4 that are continuous in a circumferential direction with borders in between that are represented by the alternate long and short dash lines in FIG. 3. In this case, the outer circumferential edge 43 is formed of a plurality of outer circumferential edge parts 49-1 to 49-4 that are continuous in the circumferential direction with the borders in between that are represented by the alternate long and short dash lines in FIG. 3. The outer circumferential edge part 49-1 (a first outer circumferential edge part) corresponding to the outer circumferential part 48-1 among the outer circumferential edge parts 49-1 to 49-4 is formed in the outer circumferential part 48-1. The outer circumferential edge part 49-2 (a second outer circumferential edge part) corresponding to the outer circumferential part 48-2 among the outer circumferential edge parts 49-1 to 49-4 is formed in the outer circumferential part 48-2. The outer circumferential edge part 49-3 (a third outer circumferential edge part) corresponding to the outer circumferential part 48-3 among the outer circumferential edge parts 49-1 to 49-4 is formed in the outer circumferential part 48-3. The outer circumferential edge part 49-4 (a fourth outer circumferential edge part) corresponding to the outer circumferential part 48-4 among the outer circumferential edge parts 49-1 to 49-4 is formed in the outer circumferential part 48-4.

In this case, the lengths of the outer circumferential edge parts 49-1 to 49-4 are different from one another and the angles of a plurality of center angles θ1 to θ4 corresponding to the outer circumferential edge parts 49-1 to 49-4 are different from one another. In other words, a center angle θ1 (first center angle) corresponding to the outer circumferential edge part 49-1 is an angle between two straight lines that are extended to both ends of the outer circumferential edge part 49-1, respectively, from a center point 50 at which the rotation axis 16 intersects with a plane surface along which the partition plate 42 is. A center angle θ2 (second center angle) corresponding to the outer circumferential edge part 49-2 is an angle between two straight lines that are extended to both ends of the outer circumferential edge part 49-2, respectively, from the center point 50. The angle of the center angle θ2 is different from the angle of the center angle θ1. A center angle θ3 (third center angle) corresponding to the outer circumferential edge part 49-3 is an angle between two straight lines that are extended to both ends of the outer circumferential edge part 49-3, respectively, from the center point 50. The angle of the center angle θ3 is different from the angle of the center angle θ1 and is different from the angle of the center angle θ2. A center angle θ4 (fourth center angle) corresponding to the outer circumferential edge part 49-4 is an angle between two straight lines that are extended to both ends of the outer circumferential edge part 49-4, respectively, from the center point 50. The angle of the center angle θ4 is different from the angle of the center angle θ1, is different from the angle of the center angle θ2, and is different from the center angle θ3.

Figure 4:
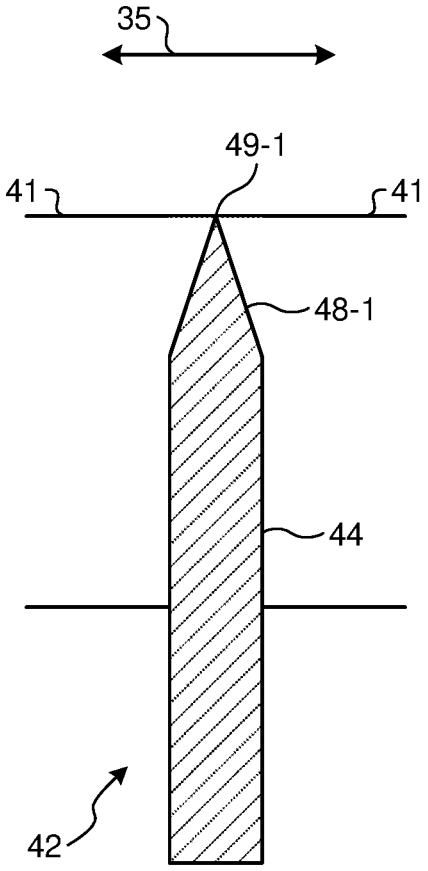
FIG. 4 is a cross-sectional view illustrating an outer circumferential part.

FIG. 4 is a cross-sectional view illustrating the outer circumferential part 48-1. The outer circumferential part 48-1 is formed such that the outer circumferential edge part 49-1 is sharp, that is, gets thinner toward the outer circumferential edge part 49-1. In this case, the thickness of a part in the outer circumferential part 48-1 is approximately proportional to a distance between the part and the outer circumferential edge part 49-1. Furthermore, the thickness of an end in the outer circumferential part 48-1 leading to the body part 44 is equal to the thickness of the body part 44.

Figure 5:
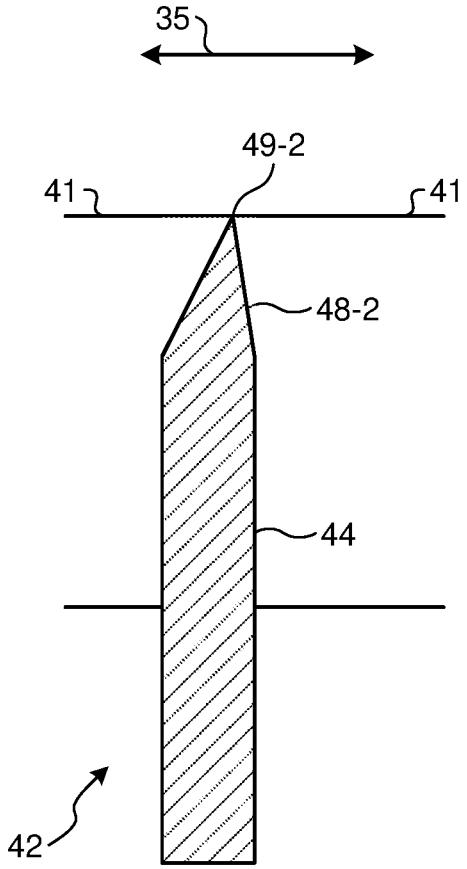
FIG. 5 is a cross-sectional view illustrating another outer circumferential part different from the outer circumferential part.

FIG. 5 is a cross-sectional view illustrating the outer circumferential part 48-2 that is another one different from the outer circumferential part 48-1. Approximately as the outer circumferential part 48-1 is, the outer circumferential part 48-2 is formed such that the outer circumferential edge part 49-2 is sharp, that is, gets thinner toward the outer circumferential edge part 49-2. In this case, the thickness of a part in the outer circumferential part 48-2 is approximately proportional to a distance between the part and the outer circumferential edge part 49-2. Furthermore, the thickness of an end in the outer circumferential part 48-2 leading to the body part 44 is equal to the thickness of the body part 44. The position (second position) of the outer circumferential edge part 49-2 in the axial direction 35 is different from the position (first position) of the outer circumferential edge part 49-1 in the axial direction 35.

Approximately as the outer circumferential part 48-1 is, the outer circumferential part 48-3 is formed such that the outer circumferential edge part 49-3 is sharp. The position (third position) of the outer circumferential edge part 49-3 in the axial direction 35 is different from the position (first position) of the outer circumferential edge part 49-1 in the axial direction 35 and is different from the position (second position) of the outer circumferential edge part 49-2 in the axial direction 35. Approximately as the outer circumferential part 48-1 is, the outer circumferential part 48-4 is formed such that the outer circumferential edge part 49-4 is sharp. The position (fourth position) of the outer circumferential edge part 49-4 in the axial direction 35 is different from the position (first position) of the outer circumferential edge part 49-1 in the axial direction 35, is different from the position (second position) of the outer circumferential edge part 49-2 in the axial direction 35, and is different from the position (third position) of the outer circumferential edge part 49-3 in the axial direction 35.

As for another partition plate different from the partition plate 42 among the partition plates 32, the outer circumferential part of the partition plate 42 is replaced with another outer circumferential edge part and other parts are formed similarly to those of the partition plate 42. The shape of the replaced outer circumferential part is different from the shape of the outer circumferential part of the partition plate 42 such that the center angles corresponding to the center angles θ1 to θ4 in the outer circumferential part are different from the center angles θ1 to 64 of the partition plate 42. As described above, the shapes of the partition plates 32 are different from one another such that the parts corresponding to the center angles θ1 to θ4 differ.

The air conditioner circulates a refrigerant through the indoor equipment 10 and the outdoor equipment. The outdoor equipment performs a heat exchange between the refrigerant and the external air. The fan 1 causes the tangential fan 8 to rotate on the rotation axis 16 in a rotation direction 40. The tangential fan 8 rotates and accordingly the fan 1 supplies the air in the air-conditioned room from the intake 6 of the indoor equipment 10 to the air path 5. The heat exchanger 3 performs a heat exchange between the air that is supplied from the intake 6 to the air path 5 to adjust the temperature of the air that is supplied to the air path 5. The tangential fan 8 rotates and accordingly the fan 1 further blows out the air whose temperature is adjusted by the heat exchanger 3 from the blow-out port 12 to the air-conditioned room. The air conditioner is able to cool or warm the air-conditioned room by such operations.

When air whose temperature is adjusted by the heat exchanger 3 flows through the blow path 11, part of the air flowing through the blow path 11 strikes each of the outer circumferential edges 43 of the partition plates 32. The outer circumferential edges 43 are sharp and thus the fan 1 is able to attenuate the strike of the air at the outer circumferential edge parts 49-1 to 49-4, reduce a turbulence flow of the air flowing through the blow path 11 and separation phenomenon resulting from the strike of the air, and reduce a pressure loss caused when the air flows through the blow path 11. The pressure loss is reduced and accordingly the fan 1 is able to reduce power that is consumed when the motor unit not illustrated in the drawing causes the tangential fan 8 to rotate. Furthermore, a border layer in which the wind velocity is low compared to the main flow near the surface of the partition plates 32 is formed and, because the positions of the outer circumferential edges 43 of the partition plates 32 in the axial direction 35 are different, the fan 1 is able to increase the width of the main flow flowing between the wings 41 that are lined in the circumferential direction. By increasing the width of the main flow flowing between adjacent partition plates among the partition plates 32 in the axial direction 35, the indoor equipment 10 is able to reduce the pressure loss of the air passing through the fan 1. Furthermore, because the lengths of the outer circumferential edge parts 49-1 to 49-4 are different from one another, the fan 1 is able to reduce the sound pressure energy of pitches.

Fan of Comparative Example

In a fan of a comparative example, the partition plates 32 of the fan 1 of the above-described embodiment are replaced with a plurality of other partition plates and other parts are the same as those of the fan 1 of the above-described embodiment. As for the replaced partition plates, a thickness of an outer circumferential part is constant and is equal to the thickness of the body part 44. In other words, the outer circumferential edges of the partition plates are not sharp and end faces along a cylindrical face on the rotation axis 16 serving as a center axis are formed at the outer circumferential edges.

Figure 6:
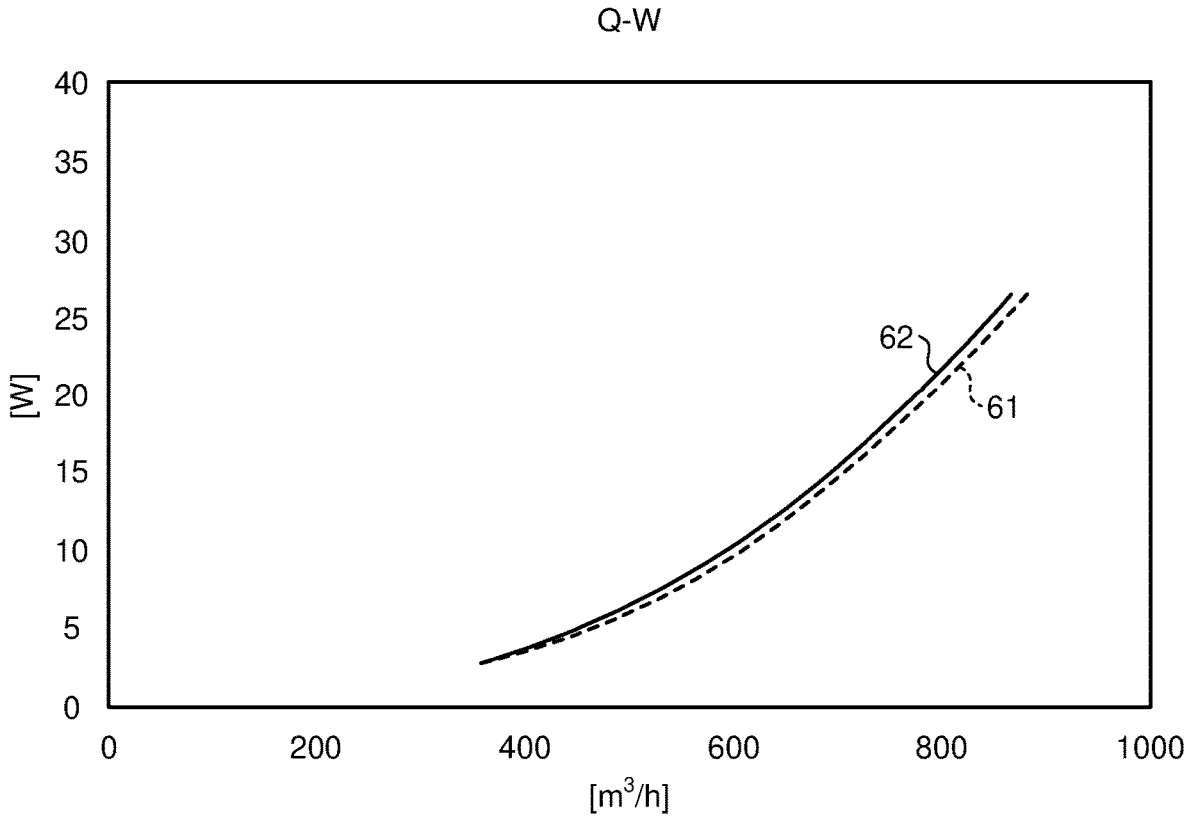
FIG. 6 is a graph presenting a relationship between the air volume and the amount of input of the fan of the embodiment and presenting a relationship between the air volume and the amount of input of a fan of a comparative example.

FIG. 6 is a graph presenting a relationship between the air volume and the amount of input of the fan 1 of the embodiment and presenting a relationship between the air volume and the amount of input of the fan of the comparative example. The air volume represents a volume of air that the fan 1 or the fan of the comparative example blows out of the blow-out port 12 per unit of time. The amount of input represents a power that the fan 1 or the fan of the comparative example consumes to cause the tangential fan to rotate when air is blown out of the blow-out port 12. A curve 61 represents that, the larger the air volume of the fan 1 is, the larger the amount of input of the fan 1 is. A curve 62 represents that, the larger the air volume of the fan of the comparative example is, the larger the amount of input of the fan of the comparative example is. The curve 61 and the curve 62 present that, when the air volume of the fan 1 and the air volume of the fan of the comparative example are equal, the amount of input of the fan 1 is smaller than the amount of input of the fan of the comparative example. In other words, the curve 61 and the curve 62 present that the fan 1 is able to reduce the amount of input. The curve 61 and the curve 62 further present that the fan 1 reduces the pressure loss of air passing through the tangential fan 8.

Effect of Fan 1 of Embodiment

The fan 1 of the embodiment includes the tangential fan 8 and the motor unit that causes the tangential fan 8 to rotate on the rotation axis 16. The tangential fan 8 includes the impellers 31 that are lined in the axial direction 35 that is parallel to the axial direction rotation axis 16; and the partition plate 42 that is arranged along a plane that is perpendicular to the axial direction 35. The partition plate 42 includes the body part 44 that separates two impellers among the impellers 31; and the outer circumferential part 45 that surrounds an outer circumferential side of the body part 44 perpendicular to the rotation axis. The outer circumferential part 45 is formed such that the outer circumferential part 45 gets thinner toward the outer circumferential edge 43 of the partition plate 42, that is, the outer circumferential edge 43 is sharp. The outer circumferential edge 43 of the partition plate 42 is formed of the outer circumferential edge parts 49-1 to 49-4 that are continuous in the circumferential direction. A position of the outer circumferential edge part 49-1 among the outer circumferential edge parts 49-1 to 49-4 in the axial direction 35 is different from a position of the outer circumferential edge part 49-2 different from the circumferential edge part 49-1 among the outer circumferential edge parts 49-1 to 49-4 in the axial direction 35.

In this case, because the outer circumferential edge 43 of the partition plate 42 is sharp, the fan 1 of the embodiment is able to reduce the pressure loss caused when air is blown and reduce the amount of input. Furthermore, because the positions of the outer circumferential edge parts 49-1 to 49-4 in the axial direction 35 are different from one another, the fan 1 of the embodiment is able to increase the width of the main flow flowing between adjacent partition plates among the partition plates 32 in the axial direction 35. The blown air is distributed in the axial direction 35 and therefore the indoor equipment 10 provided with the fan 1 of the embodiment is able to send air whose temperature is adjusted to the air-conditioned room at a wide angle and cool or warm the air-conditioned room appropriately.

The angle of the center angle θ1 corresponding to the outer circumferential edge part 49-1 of the fan 1 of the embodiment is different from the angle of the center angle θ2 corresponding to the outer circumferential edge part 49-2. The center angle θ1 is an angle between two straight lines that are extended to both ends of the outer circumferential edge part 49-1, respectively, from the center point 50 at which the rotation axis 16 intersects with a plane along which the partition plate 42 is. The center angle θ2 is an angle between two lines that are extended to both ends of the outer circumferential edge part 49-2, respectively, from the center point 50. In this case, because the lengths of the outer circumferential edge parts 49-1 to 49-4 in the circumferential direction are different from one another, the fan 1 of the embodiment is able to increase the width of the main flow flowing between adjacent partition plates among the partition plates 32 in the axial direction 35.

The tangential fan 8 of the fan 1 of the embodiment further includes another partition plate that is arranged along another plane that is parallel to the plane along which the partition plate 42 is. As in the partition plate 42, the outer circumferential edge 43 is sharp, that is, the partition plate is formed such of the partition plate gets thinner toward the outer circumferential edge 43. As the outer circumferential edge 43 of the partition plate 42 is, the outer circumferential edge of the partition plate is formed of a plurality of outer circumferential edge parts whose positions in the axial direction 35 are different from one another. In this case, the fan 1 of the embodiment is able to further reduce the pressure loss of air that is blown compared to the fan provided with only one partition plate in which the outer circumferential edge parts 49-1 to 49-4 are formed.

The shapes of the partition plates 32 of the fan 1 of the embodiment are different from one another such that the angles of the center angles θ1 to θ4 are different in each partition plate. In this case, the positions of the outer circumferential edge parts 49-1 to 49-4 do not synchronize between the partition plates 32. For this reason, the fan 1 of the embodiment is able to increase the width of the main flow flowing between adjacent partition plates among the partition plates 32 in the axial direction 35 compared to another fan in which the positions of the outer circumferential edge parts 49-1 to 49-4 in the axial direction 35 are synchronized.

In the fan 1 of the above-described embodiment, the center angles θ1 to θ4 are different in each of the partition plates 32; however, the shapes of the partition plates 32 may be uniform with one another. Even when the shapes of the partition plates 32 are uniform, the fan is able to reduce the pressure loss of air that is blown as the fan 1 of the above-described embodiment is.

In the fan 1 of the above-described embodiment, the partition plates 32 are formed such that the center angles θ1 to θ4 are different from one another; however, the partition plates 32 may be formed such that the center angles θ1 to θ4 are equal to one another. Even when the center angles θ1 to θ4 are equal to one another, the fan is able to reduce the pressure loss of air that is blown as the fan 1 of the above-described embodiment is.

In the fan 1 of the above-described embodiment, all the outer circumferential edges 43 of the partition plates 32 are sharp; however, the partition plate 42 whose outer circumferential edge 43 is not sharp may be contained in the partition plates. Even when partition plates whose outer circumferential edge 43 are not sharp are contained partly, the fan is able to reduce the pressure loss of air that is blown as the fan 1 of the above-described embodiment is.

The partition plates 32 of the fan 1 of the above-described embodiment are provided in the tangential fan 8 that takes air in from a radial direction and blows the air out in another radial direction; however, the partition plates 32 may be provided in a multi wing fan that is different from the tangential fan. A centrifugal fan that takes air in from the axial direction and blows the air out in the radial direction is exemplified as the tangential fan 8. Such a fan is also able to reduce the pressure loss of air that is blown as the fan 1 of the above-described embodiment is.

The fan 1 of the above-described embodiment is used for the indoor equipment 10 of the air conditioner; however, the fan 1 may be used for another apparatus different from the indoor equipment 10. An air curtain apparatus is exemplified as the apparatus.

The embodiment has been exemplified; however, the above-described content does not limit the embodiment. The above-described components include one that is assumable easily by those skilled in the art and one substantially the same, that is, within a range of equivalents. Furthermore, the above-described components can be combined as appropriate. Furthermore, at least one of various types of omission, replacement and change of the components may be performed within the scope of the embodiment.

REFERENCE SIGNS LIST

1 FAN
2 CASING
3 HEAT EXCHANGER
5 AIR PATH
6 INTAKE
7 FAN CASING
8 TANGENTIAL FAN
10 INDOOR EQUIPMENT
11 BLOW PATH
12 BLOW-OUT PORT
14 FRONT-FACE-SIDE TONGUE PART
15 BACK-FACE-SIDE TONGUE PART
16 ROTATION AXIS
31 IMPELLERS
32 PARTITION PLATES
33 FIRST END PLATE
34 SECOND END PLATE
35 AXIAL DIRECTION
36 IMPELLER
42 PARTITION PLATE
43 OUTER CIRCUMFERENTIAL EDGE
44 BODY PART
45 OUTER CIRCUMFERENTIAL PART
48-1 TO 48-4 OUTER CIRCUMFERENTIAL PARTS
49-1 TO 49-4 OUTER CIRCUMFERENTIAL EDGE PARTS
50 CENTER POINT

The invention claimed is:

1. A fan comprising:
a multi wing fan; and
a mechanism configured to rotate the multi wing fan around a rotation axis,
wherein the multi wing fan includes
a plurality of impellers that are lined in an axial direction that is parallel to the rotation axis; and
a partition plate that is arranged along a plane that is perpendicular to the rotation axis,
the partition plate includes
a body part that separates two impellers among the plurality of impellers; and
an outer circumferential part that surrounds an outer circumferential side of the body part that is perpendicular to the rotation axis,
the outer circumferential part is sharp such that the outer circumferential part gets thinner toward an outer circumferential edge of the partition plate,
the outer circumferential edge of the partition plate is formed of a plurality of outer circumferential edge parts that are continuous in a circumferential direction, and
a first position of a first outer circumferential edge part among the plurality of outer circumferential edge parts in the axial direction is different from a second position of a second outer circumferential edge part different from the first outer circumferential edge part among the plurality of outer circumferential edge parts in the axial direction.

2. The fan according to claim 1, wherein an angle of a first center angle between two straight lines that are extended to both ends of the first outer circumferential edge part, respectively, from a center point at which the rotation axis intersects with the plane is different from an angle of a second center angle between two lines that are extended to both ends of the second outer circumferential edge part, respectively, from the center point.

3. The fan according to claim 1, wherein the multi wing fan further includes another partition plate that is arranged along another plane that is parallel to the plane,
the another partition plate includes
another body part that separates two other impellers different from the two impellers among the impellers; and
another outer circumferential part that surrounds an outer circumferential side of the another body part that is perpendicular to the rotation axis,
the another outer circumferential part is formed such that the another outer circumferential part gets thinner toward an outer circumferential edge of the another partition plate,
the outer circumferential edge of the another partition plate is formed of a plurality of other outer circumferential edge parts that are continuous in the circumferential direction, and
a third position of a third outer circumferential edge part among the plurality of other outer circumferential edge parts in the axial direction is different from a fourth position of a fourth outer circumferential edge part different from the third outer circumferential edge part among the plurality of other outer circumferential edge parts in the axial direction.

4. The fan according to claim 3, wherein a shape of the another outer circumferential part is different from a shape of the outer circumferential part.

5. Indoor equipment comprising:
a heat exchanger; and
the fan according to claim 1 configured to generate an airflow that passes through the heat exchanger.

* * * * *